US006085707A

United States Patent [19]

Nemoto et al.

[11] Patent Number: 6,085,707

[45] Date of Patent: Jul. 11, 2000

[54] VALVE OPERATING SYSTEM IN INTERNAL COMBUSTION ENGINE

[75] Inventors: Hirotomi Nemoto; Shigemasa Kajiwara, both of Wako, Japan

[73] Assignee: Honda Giken Kogvo Kabushiki Kaisha, Tokyo, Japan

[21] Appl. No.: 09/085,168

[22] Filed: May 28, 1998

[30] Foreign Application Priority Data

May 29, 1997 [JP] Japan ..... 9-139776

[51] Int. Cl.[7] ..... F01L 13/00

[52] U.S. Cl. ..... 123/90.16; 123/90.15; 123/90.36; 123/90.39

[58] Field of Search ..... 123/90.12, 90.13, 123/90.15, 90.16, 90.17, 90.22, 90.23, 90.36, 90.39, 198 D

[56] References Cited

U.S. PATENT DOCUMENTS

| | | | |
|---|---|---|---|
| 4,747,375 | 5/1988 | Williams | 123/90.15 |
| 4,887,561 | 12/1989 | Kishi | 123/90.16 |
| 5,133,310 | 7/1992 | Hitomi et al. | 123/90.15 |
| 5,289,805 | 3/1994 | Quinn, Jr. et al. | 123/90.17 |
| 5,327,859 | 7/1994 | Pierik et al. | 123/90.17 |
| 5,329,894 | 7/1994 | Phoenix et al. | 123/90.17 |
| 5,499,606 | 3/1996 | Robnett et al. | 123/90.12 |
| 5,529,034 | 6/1996 | Sone et al. | 123/90.17 |
| 5,680,841 | 10/1997 | Hu | 123/322 |
| 5,839,400 | 11/1998 | Vattaneo et al. | 123/90.16 |

FOREIGN PATENT DOCUMENTS

| | | |
|---|---|---|
| 5-33840 | 2/1993 | Japan . |
| 5-79450 | 3/1993 | Japan . |
| 5-157149 | 6/1993 | Japan . |
| 6-34005 | 2/1994 | Japan . |
| 6-66360 | 3/1994 | Japan . |
| 7-107368 | 11/1995 | Japan . |

*Primary Examiner*—Weilun Lo

*Attorney, Agent, or Firm*—Arent, Fox Kintner Plotkin & Kahn

[57] ABSTRACT

In a valve operating system in an internal combustion engine, the operational characteristic of an engine valve which is an intake valve or an exhaust valve can be changed in accordance with the operational state of the engine, the reduction in size thereof can achieved and moreover, the operational characteristic of the engine valve can be finely changed, and the lifted state of the engine valve can be detected simply. A power transmitting device is formed of an inner wheel, an outer wheel and a carrier which rotatably carries a planetary rotor. Among these components forming the power transmitting device, a first component is operatively connected to a cam shaft, and a second component is connected to an engine valve. A rotational amount control device connected to a third component, controls the amount of rotation of the third component in accordance with the operational state of the engine. A first discharge bore is provided in a support shaft supporting the inner wheel and leads to an oil passage, and a second discharge bore provided in the inner wheel, communicates with the first discharge bore. The area of communication of the second discharge bore with the first discharge bore can be changed with a change in the amount of relative angular displacement of the inner wheel relative to the support shaft.

12 Claims, 10 Drawing Sheets

VALVE OPERATING SYSTEM IN INTERNAL COMBUSTION ENGINE

BACKGROUND OF THE INVENTION

1. Field of the Invention

The present invention relates to a valve operating system for an internal combustion engine, and more particularly, to a valve operating system in an internal combustion engine, which is designed so that the operational characteristic of an engine valve which is an intake valve or an exhaust valve, can be changed in accordance with the operational state of the engine.

2. Description of the Prior Art

A valve operating system in which the intake and exhaust valve characteristics can be changed is already known, for example, from Japanese Patent Publication No.7-107368 or the like.

The above known system is arranged, so that a rocker arm connected to the engine valve, is driven in an alternatively switched manner by a plurality of valve operating cams having different cam profiles, whereby the operational characteristic of the engine valve is switched between two or three stages, in accordance with the operational state of the engine. However, to further enhance the engine performance such as output torque from the engine, specific fuel consumption and exhaust gas properties, it is desirable that the operational characteristic of the engine valve be switched more finely in accordance with the operational state of the engine. In the arrangement of the above known valve operating system, a larger number of valve operating cams having different cam profiles are required, resulting in an increase in size of the valve operating system, and in difficulty to realize the valve operating system.

In addition, the above known valve operating system includes no means for detecting the lift state of the engine valve and hence, it is difficult to carry out feedback control of the engine valve and to detect an abnormality in the lifting of the engine valve.

SUMMARY OF THE INVENTION

The present invention has been developed with the above circumstance in view, and it is an object of the present invention to provide a valve operating system in an internal combustion engine, wherein a reduction in size thereof can be achieved and moreover, the operational characteristic of the engine valve can be finely changed, and the lift state of the engine valve can be detected simply.

To achieve the above object, there is provided a valve operating system in an internal combustion engine in which the operational characteristic of an engine valve can be changed in accordance with the operational state of the engine. The valve operating system comprises a power transmitting means formed of three components: an inner wheel supported on a support shaft having an oil passage provided therein, for rotation about an axis of the support shaft, an outer wheel surrounding the inner wheel and capable of being rotated about the same axis as the inner wheel, and a carrier which carries a planetary rotor disposed between the inner wheel and the outer wheel for rotation about an axis parallel to the axes of the inner wheel and the outer wheel and which is rotated in operative association with the revolution of the planetary rotor about the inner wheel. A first component of the three components is operatively connected to a valve operating cam of a cam shaft for rotation in response to the rotation of the cam shaft, and a second component is connected to the engine valve. A rotational amount control means connected to a third component of the three components of the power transmitting means, controls the amount of rotation of the third component in accordance with the operational state of the engine. An oil supply means is connected to the oil passage and is capable of discharging oil at a given pressure; and a hydraulic pressure detecting means is provided between the oil supply means and the oil passage. The support shaft has a first discharge bore provided therein leading to the oil passage, and the inner wheel or a member rotated with the inner wheel has a second discharge bore provided therein which is capable of communicating with the first discharge bore, so that an area of communication of the second discharge bore with the first discharge bore can be changed, as an amount of relative angular displacement of the inner wheel relative to the support shaft is changed in accordance with a change in lift amount of the engine valve.

With the above arrangement of the three components forming the power transmitting means, the first and second components are operatively connected to the cam shaft and the engine valve, respectively, and the amount of rotation of the third component is controlled by the rotational amount control means, whereby the rotation of the second component with the rotation of the first component by the rotation of the cam shaft, i.e., the operational characteristic of the engine valve, is controlled. Thus, the operational characteristic of the engine valve can be more finely controlled by more finely controlling the amount of rotation of the third component by the rotational amount control means. Moreover, by the fact that the power transmitting means comprises the three components forming it, i.e., the inner wheel, the outer wheel and the carrier which are disposed for rotation about the same axis, the power transmitting means can be compactly formed, thereby providing a reduction in size of the valve operating system. In addition, the amount of relative angular displacement of the inner wheel relative to the support shaft is changed with the change in lift amount of the engine valve, whereby the hydraulic pressure in the oil passage is changed by changing of the area of communication between the second discharge bore and the first discharge bore. Thus, it is possible to easily detect the lift state of the engine valve by detecting the change in hydraulic pressure using the hydraulic pressure detecting means.

The power transmitting means is formed into a planetary gear mechanism comprising a sun gear which is the inner wheel, a ring gear which is the outer wheel, and a carrier which rotatably carries a planetary gear which is the planetary rotor. Thus, it is possible to precisely control the operational characteristic of the engine valve by the meshing connection of the components forming the power transmitting means, with one another.

Further, the second discharge bore opens toward the outer wheel. Thus, the oil discharged from the second discharge bore can be effectively utilized for lubrication of the outer wheel.

A single hydraulic pressure detecting means common to a plurality of cylinders is provided between a single oil supply means and the single oil passage provided in the support shaft, common to the power transmitting means for the cylinders. Thus, the lift state of the engine valve for each of the cylinders can be easily detected with a smaller number of parts.

The hydraulic pressure detecting means includes a hydraulic pressure sensor, and a filter to which a value detected by said hydraulic pressure sensor, is inputted. Thus, it is possible to simply average the values detected by the hydraulic pressure sensor by allowing the detected values to pass through the filter, and to thereby easily detect the lift state of the engine valve on the basis of the averaged hydraulic pressure.

The valve operating system further includes an operational amount control means for controlling the operation of the rotational amount control means, to allow the operational characteristic of the engine valve to approach a target characteristic on the basis of the value detected by the hydraulic pressure detecting means. Thus, it is possible to carry out the feedback control of the engine valve with a simple arrangement, leading to an enhanced accuracy of the control of the operational characteristic of the engine valve.

The valve operating system further includes an abnormality detecting means for detecting an abnormality in the operational state of the engine valve on the basis of the value detected by the hydraulic pressure detecting means. Thus, it is possible to detect an abnormality in the operation of the engine valve with a simple arrangement.

DETAILED DESCRIPTION OF THE PREFERRED EMBODIMENT

Figure 1:
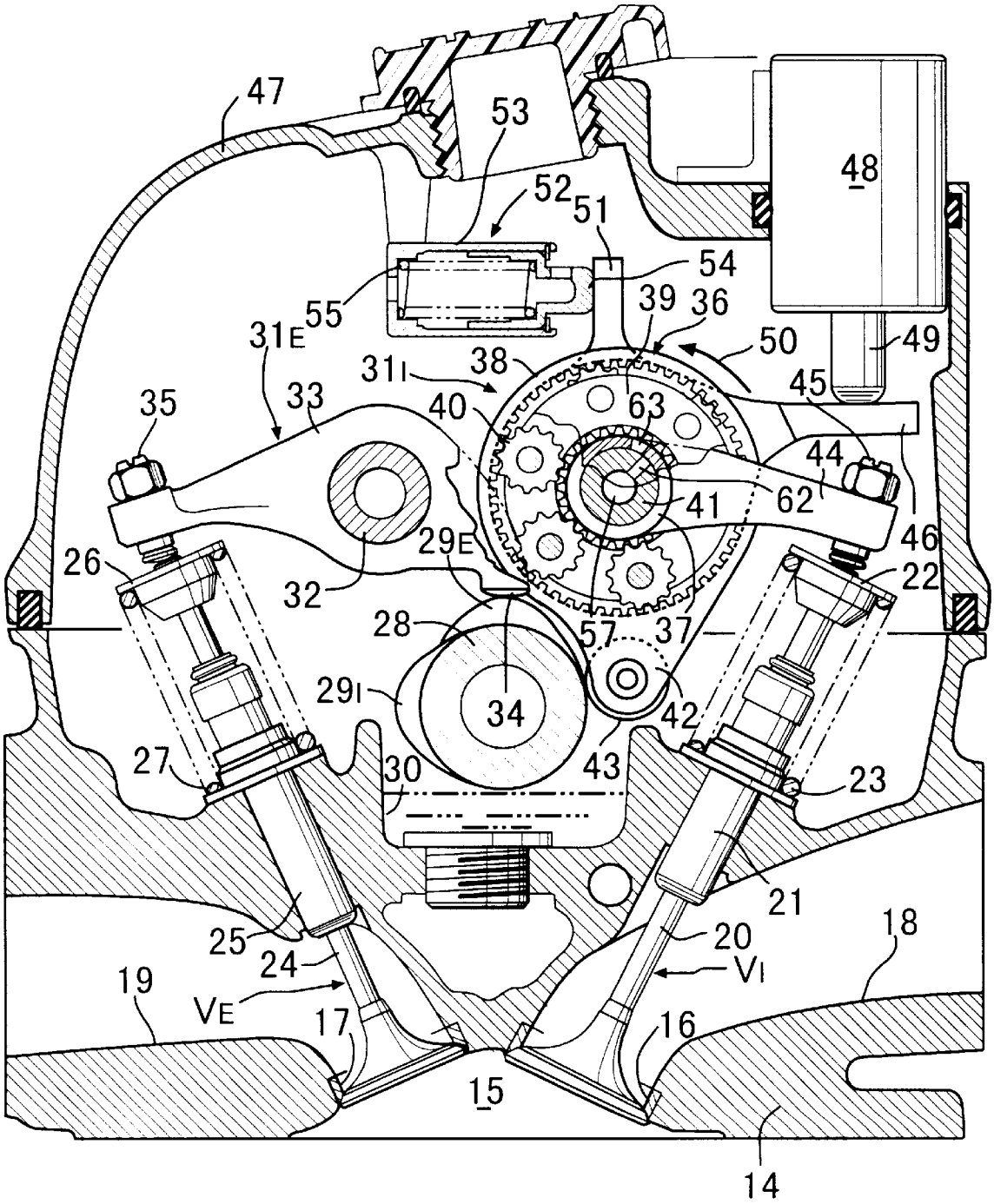
FIG. 1 is a longitudinal sectional view of an essential portion of an internal combustion engine according to a first embodiment of the present invention.

Referring to FIG. 1, a combustion chamber 15 is defined between an upper surface of a piston slidably received in a cylinder block (not shown) and a cylinder head 14. A pair of intake valve bores 16 and a pair of exhaust valve bores 17 are provided in the cylinder head 14 such that they open into a ceiling surface of the combustion chamber 15. The intake valve bores 16 communicate with an intake port 18, and the exhaust valve bores 17 communicate with an exhaust port 19.

Intake valves $V_I$, a pair of engine valves for individually opening and closing the intake valve bores 16, have stems 20 slidably received in guide tubes 21 mounted in the cylinder head 14. Coiled valve springs 23 are mounted between the cylinder head 14 and retainers 22 mounted at upper ends of the stems 20 which protrude upwards from the guide tubes 21, respectively, to surround the stems 20, so that the intake valves $V_I$ are biased in a direction to close the intake valve bores 16, by the valve springs 23. A pair of exhaust valves $V_E$, for individually opening and closing the exhaust valve bores 17, have stems 24 slidably received in guide tubes 25 mounted in the cylinder head 14. Coiled valve springs 27 are mounted between the cylinder head 14 and retainers 26 mounted at upper ends of the stems 24 which protrude upwards from the guide tubes 25, to surround the stems 24, so that the exhaust valves $V_E$ are biased in a direction to close the exhaust valve bores 17, by the valve springs 27.

A cam shaft 28 parallel to an axis of a crankshaft (not shown) is rotatably disposed between the intake valves $V_I$ and the exhaust valves $V_E$, below the upper ends of the intake valves $V_I$ and the upper ends of the exhaust valves $V_E$. The cam shaft 28 is operatively connected to the crankshaft at a reduction ratio of ½. Moreover, an oil bath 30 is defined in an upper surface of the cylinder head 14, and the cam shaft 28 is disposed in a position in which an intake-side valve operating cam 29, and an exhaust-side valve operating cam $\mathbf{29}_E$ included in the cam shaft 28, can be immersed in the oil in the oil bath 30.

An intake-side valve operating device 31, is provided between the intake valves $V_I$ and the intake-side valve operating cam 29, on the cam shaft 28 for converting the rotational movement of the cam shaft 28 into an opening/closing operation of the intake valves $V_I$. An exhaust-side valve operating device $\mathbf{31}_E$ is provided between the exhaust valves $V_E$ and the exhaust-side valve operating cam $\mathbf{29}_E$ on the cam shaft 28, for converting the rotational movement of the cam shaft 28 into an opening/closing operation of the exhaust valves $V_E$.

The exhaust-side valve operating device $\mathbf{31}_E$ includes a rocker arm shaft 32 fixedly disposed to have an axis parallel to the cam shaft 28, and a rocker arm 33 provided between the exhaust valves $V_E$ and the exhaust-side valve operating cam $20_E$, which arm is rotatably supported on the rocker arm shaft 32. A cam slipper 34 is provided at one end of the rocker arm 33 to come into contact with the exhaust-side valve operating cam $\mathbf{29}_E$, and a pair of tappet screws 35 are threadedly inserted into the other ends of the rocker arm 33 to come into contact with upper ends of the exhaust valves $V_E$, SO that their advanced and retreated positions can be regulated.

Referring also to FIGS. 2 to 5, the intake-side valve operating device $\mathbf{31}_I$ includes a power transmitting means 36 which is formed into a planetary gear mechanism by a sun gear 37 which is an inner wheel rotatable about an axis, a ring gear 38 which is an outer wheel surrounding the sun gear 37 for rotation about the same axis as that of the sun gear 37, and a carrier 39 which carries a plurality of planetary gears 40 which are planetary rotors for rotation about an axis parallel to the axes of the sun gear 37 and the ring gear 38. The carrier 39 is rotated in operative association with the revolution of the planetary gears 40 about the sun gear 37.

The sun gear 37, the ring gear 38 and the carrier 39 are three components forming the power transmitting means 36. The sun gear 37 is rotatably carried on a support shaft 41 which is fixedly disposed between the cam shaft 28 and the intake valves $V_I$ and has an axis parallel to the cam shaft 28. The ring gear 38 is integrally provided with an arm 42 extending toward the cam shaft 28, and a roller 43 rotatably carried at a tip end of the arm 42, is in contact with the intake-side valve operating cam $\mathbf{29}_I$ of the cam shaft 28. Thus, the ring gear 38 is operatively connected to the intake-side valve operating cam $\mathbf{29}_I$ of the cam shaft 28 and is driven in rotation by the intake-side valve operating cam $29_I$ in response to the rotation of the cam shaft 28. Moreover, the operatively connected point of the ring gear 38 to the intake-side valve operating cam $29_I$, i.e., the contact point of the roller 43 with the intake-side valve operating cam $29_I$ is disposed between the intake valves $V_I$ and the cam shaft 28.

Connecting arms 44, 44 are secured to the sun gear 37. The connecting arms 44, 44 extend toward the intake valves $V_I$ on opposite sides of the ring gear 38. Tappet screws 45, 45 are threadedly inserted into tip ends of the connecting arms 44, 44 to come into contact with the upper ends of the stems 20 in the intake valves $V_I$, so that their advanced and retreated positions can be regulated. Thus, the sun gear 37 is operatively connected to the intake valves $V_I$, so that the intake valves $V_I$ are opened and closed in response to the rotation of the sun gear 37.

The carrier 39 is coaxially inserted between the sun gear 37 and the ring gear 38 and has support plates 39*a*, 39*a* at its opposite ends. The planetary gears 40 meshed with an outer periphery of the sun gear 37 and an inner periphery of the ring gear 38, are disposed at a plurality of points, e.g., at six points, which are equally spaced apart from one another, in a circumferential direction of the carrier 39. Each of the planetary gears 40 is rotatably supported at its opposite ends on the support plates 39*a*, 39*a*.

One of the support plates 39*a*, 39*a* included in the carrier 39, is integrally provided with a control arm 46 extending on the side opposite from the cam shaft 28. A rotational amount control means 48 is disposed in the head cover 47 at a location above the control arm 46. The rotational amount control means 48 includes a control rod 49 which is in contact with an upper surface of the control arm 46, so that a hydraulic pressure force or an electromagnetic force can be applied from the control rod 49 to the control arm 46, and the force applied from the control rod 49 to the control arm 46 can be continuously changed.

Figure 2:
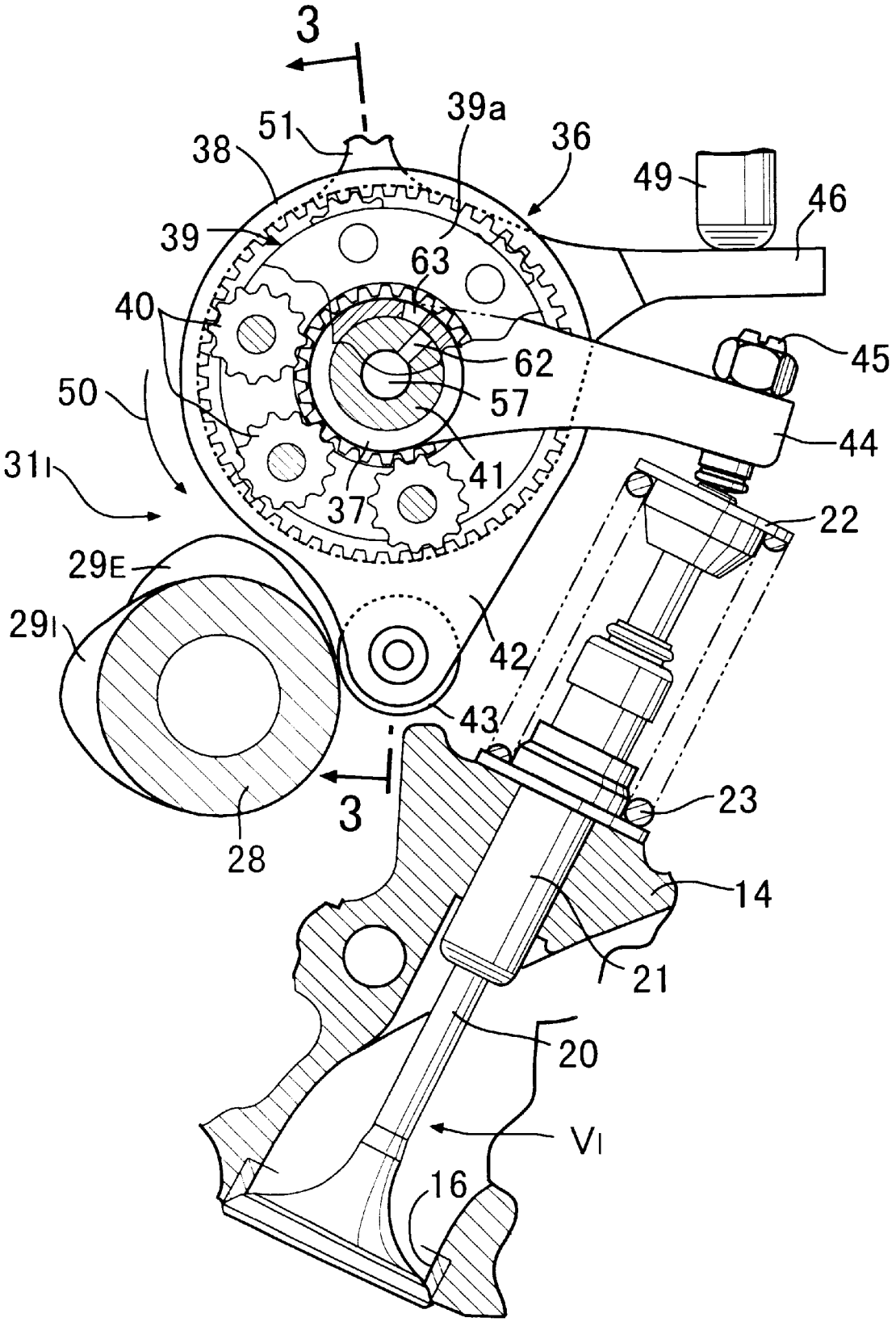
FIG. 2 is an enlarged sectional view of the essential portion shown in FIG. 1.
Figure 3:
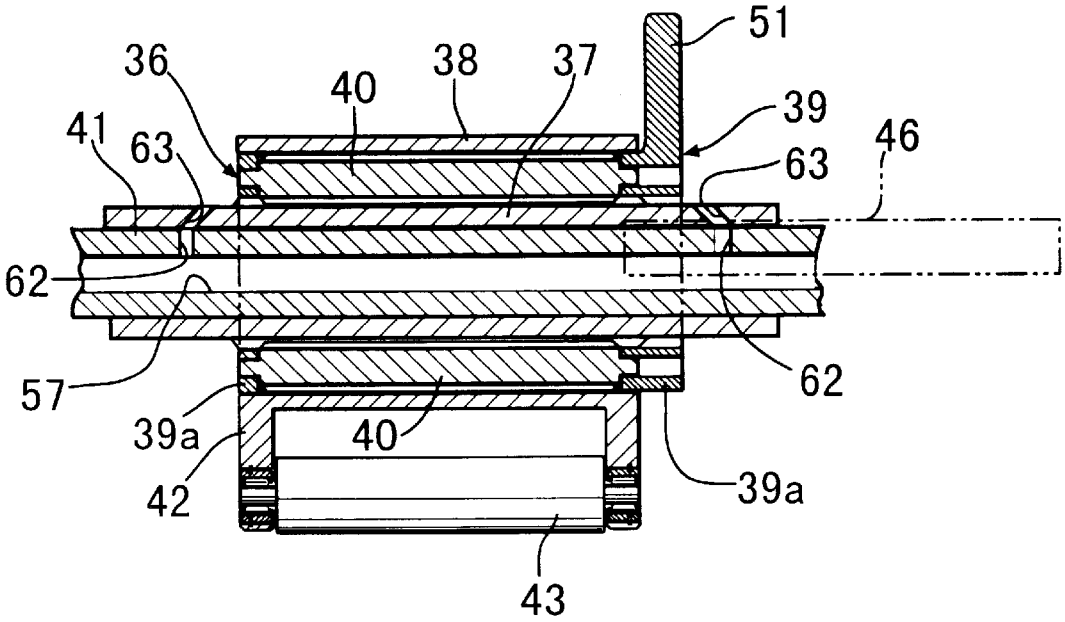
FIG. 3 is a sectional view taken along a line 3—3 in FIG. 2.
Figure 4:
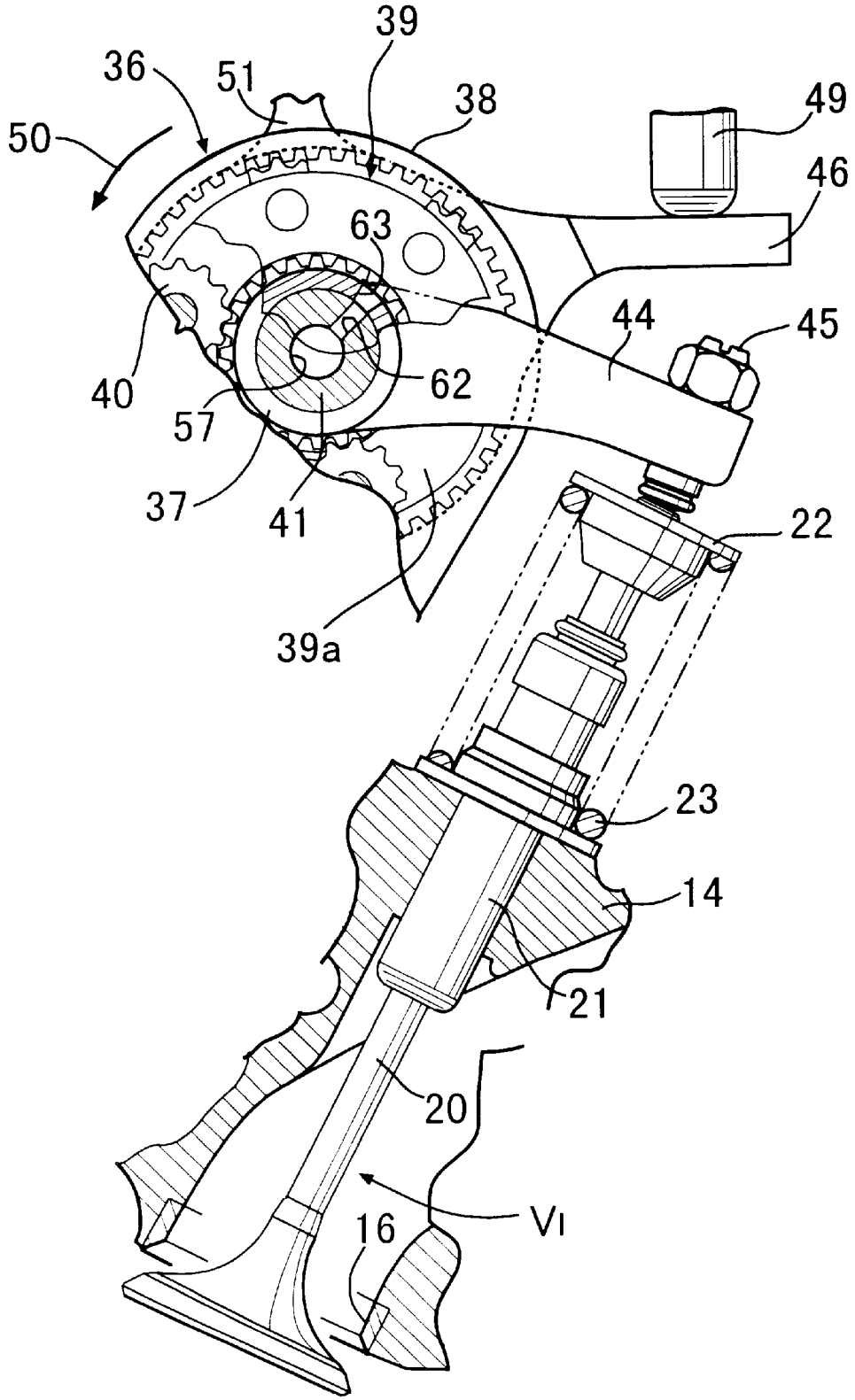
FIG. 4 is a sectional view similar to FIG. 2, but taken when a valve is opened.
Figure 5:
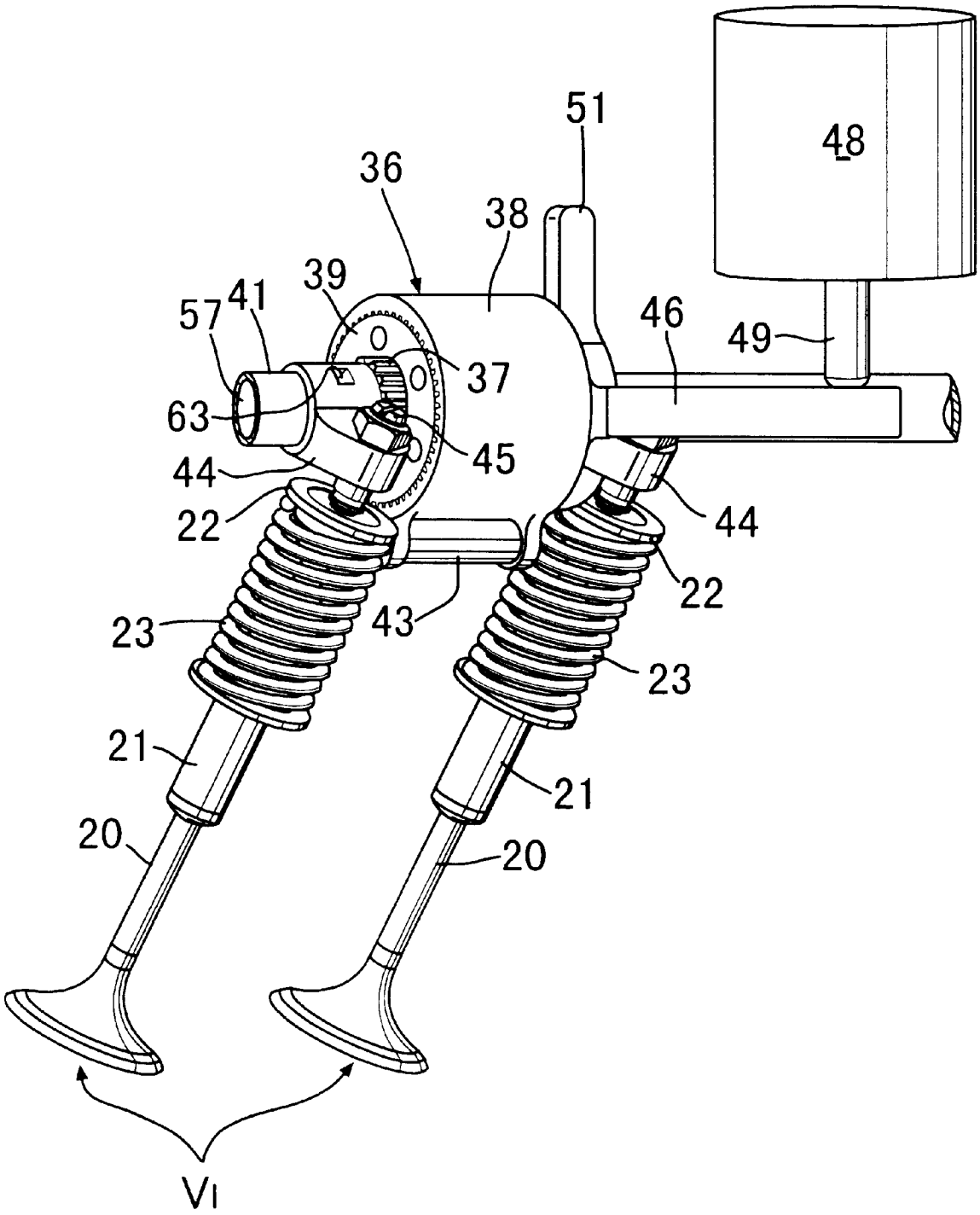
FIG. 5 is a perspective view of an intake-side valve operating device.

The ring gear 38 is rotated in a direction shown by arrow 50 in FIGS. 1, 2 and 4 by the intake-side valve operating cam $29_I$ pushing on the arm 42. However, a relatively large spring load, for example, of about 20 kgf, is applied to the intake valves $V_I$ and the sun gear 37 by the valve springs 23 and hence, when the revolution of the carrier 39 about the sun gear 37, is not controlled, the carrier 39 is freely revolved in the same direction as the arrow 50, and the intake valves $V_I$ cannot be opened and closed. However, when the revolution of the carrier 39 is controlled, each of the planetary gears 40 is rotated about its axis by an amount corresponding to the controlled amount of revolution to cause the rotation of the ring gear 38, thereby opening the intake valves $V_I$. Thus, the maximum lift amount and the opening timing, i.e., the operational characteristic of the intake valves $V_I$, can be continuously changed by continuously changing the controlled amount of revolution of the carrier 39.

The rotational amount control means 48 continuously controls the rotational amount, i.e., the amount of revolution of the carrier 39 about the sun gear 37. Thus, whereas the spring forces of the valve springs 23 for biasing the intake valves $V_I$ in the closing directions, are applied to the carrier 39 through the sun gear 37 and the planetary gears 40 to bias the control arm 46 upwards, the force for urging the control arm 46 downwards can be continuously changed. The spring force of the valve springs 23 are increased in accordance with the operation of the intake valves $V_I$ in the opening directions, and the force for urging the control arm 46 upwards is also increased in accordance with the opening operation of the intake valves $V_I$. Therefore, the changing of the force exhibited by the rotational amount control means 48, ensures that when the intake valves $V_I$ are opened to a certain opening value, the forces applied to the control arm 46 from above and below are balanced with each other. Thus, the amount of revolution of the carrier 39 about the sun gear 37 is controlled to such position, and the maximum lift position of the intake valves $V_I$ is also controlled to the position in which the forces have been balanced with each other, as described above.

The spring forces of the valve springs 23 are relatively large, as described above. If the force opposing such spring forces of the valve springs 23 is born by only the rotational amount control means 48, it leads to an increase in size of the rotational amount control means 48. Therefore, an upward extending auxiliary control arm 51 is integrally provided on one of the support plates 39a of the carrier 39, and an auxiliary-force applying means 52 is connected to the auxiliary control arm 51.

The auxiliary-force applying means 52 includes a support tube 53 fixedly supported in the head cover 47, a piston 54 slidably received in the support tube 53 with one end thereof being in contact with the auxiliary control arm 51, and a spring 55 mounted between the support tube 53 and the piston 54 to exhibit a spring force in a direction to urge the auxiliary control arm 51 by the piston 54.

Such auxiliary-force applying means 52 enables the spring force exhibited by the spring 55 to be applied to the auxiliary control arm 51, i.e., to the carrier 39 in the same direction as the control force applied from the rotational amount control means 48, and a portion of the force opposing the spring forces of the valve springs 23 can be born by the auxiliary-force applying means 52.

Figure 6:
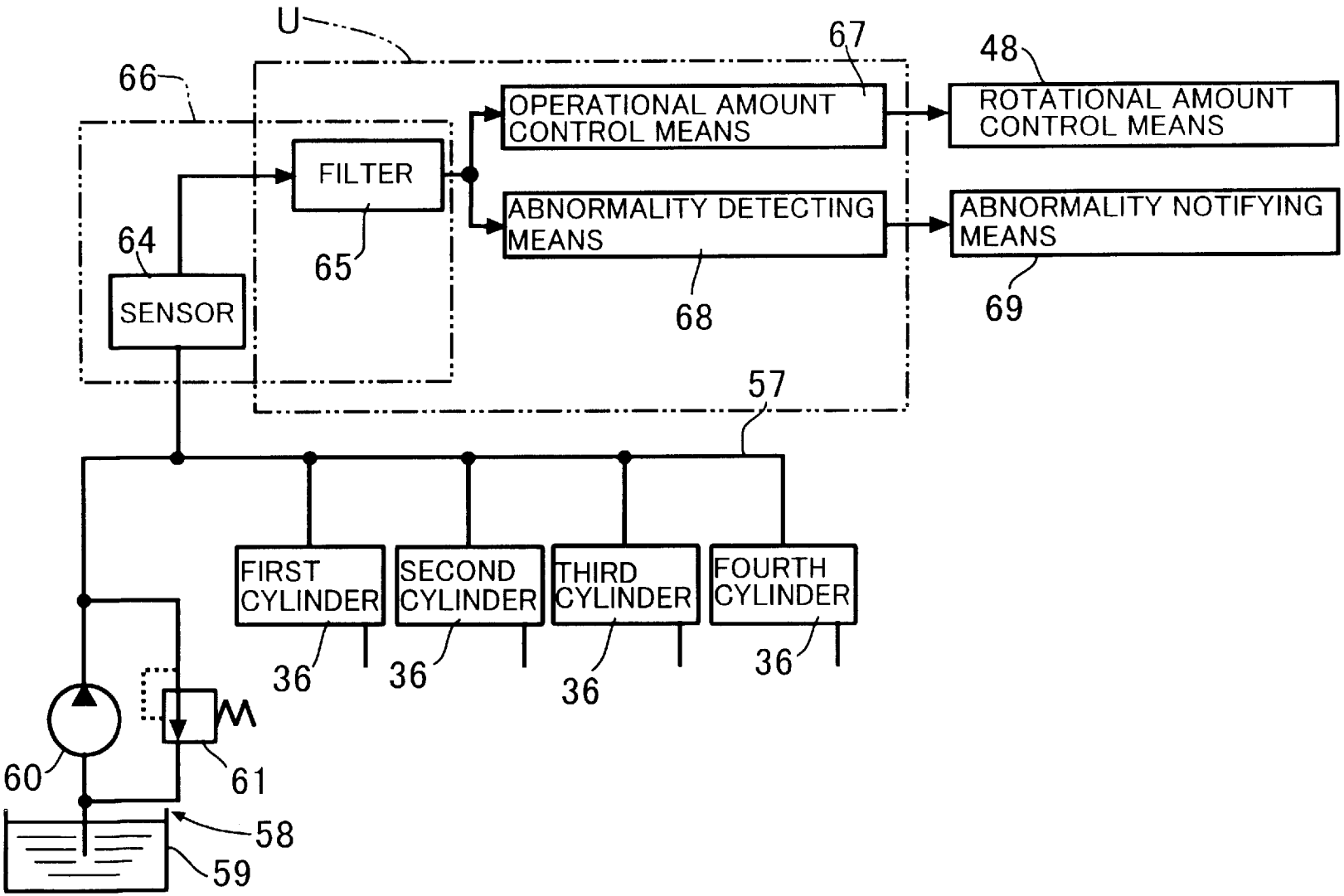
FIG. 6 is a diagram of a circuit for supplying a hydraulic pressure to each of the intake-side valve operating devices in a 4-cylinder internal combustion engine.

The support shaft 41 which supports the sun gear 37 of the power transmitting means 36 for rotation, is common to the power transmitting means 36 for a plurality of cylinders, e.g., four cylinders, and an oil passage 57 is coaxially provided in the support shaft 41. A single oil supply means 58 common to the cylinders, is connected to the oil passage 57, as shown in FIG. 6.

The oil supply means 58 comprises a tank 59 in which, for example, oil is stored, a pump 60 for pumping the oil from the tank 59, and a relief valve 61 mounted between a discharge port of the pump 60 and the tank 59, so that the oil can be always discharged at a given pressure.

On the other hand, in the power transmitting means 36 for each of the cylinders, first discharge bores 62, 62 are provided in the support shaft 41 at locations corresponding to the opposite ends of the sun gear 37 which extend outwards beyond the opposite ends of the carrier 39, and communicate with the oil passage 57. Second discharge bores 63, 63 are provided in the opposite ends of the sun gear 37 and are capable of communicating with to the first discharge bores 62, 62. Moreover, the second discharge bore 63 is provided in the sun gear 37, so that the area of communication thereof with the first discharge bore 62 can be varied with the variation in relative angular displacement amount by the sun gear 37 relative to the support shaft 41 in accordance with the variation in lift amount of the intake valve $V_I$. In this embodiment, the second discharge bore 63 is provided in the sun gear 37 in such a manner that the area of communication thereof with the first discharge bore 62, is increased in accordance with an increase in lift amount of the intake valve $V_I$, i.e., in accordance with an increase in amount of rotation of the sun gear 37 in a counterclockwise direction as viewed in FIGS. 1, 2 and 4.

Figure 7A:
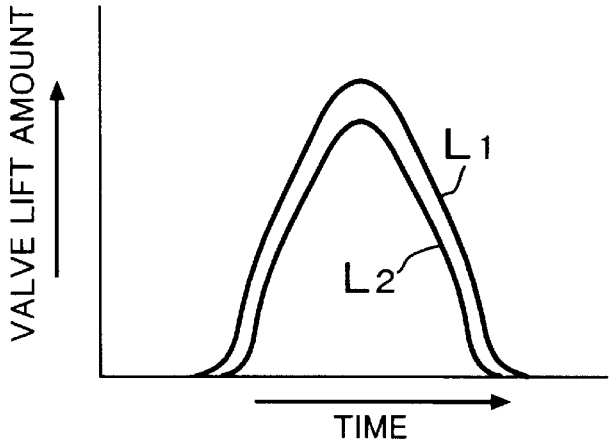
FIGS. 7A–7C are diagrams showing the variation in hydraulic pressure with respect to the variation in valve lift.
Figure 7B:
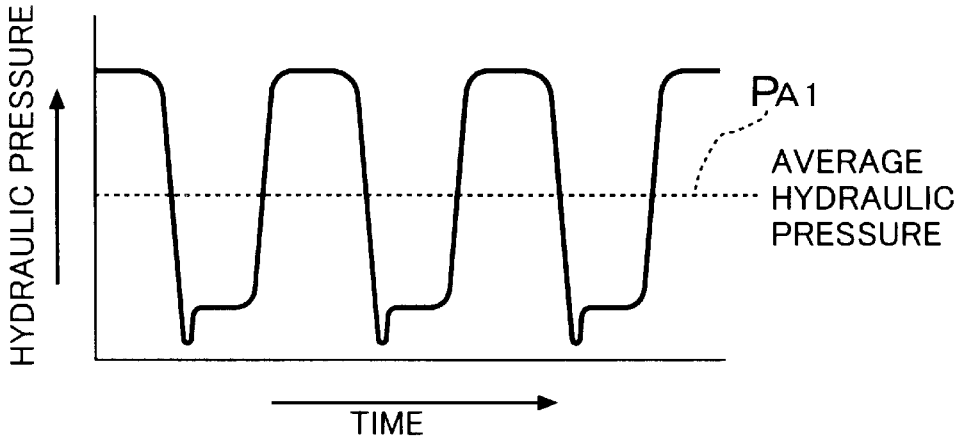
Figure 7C:
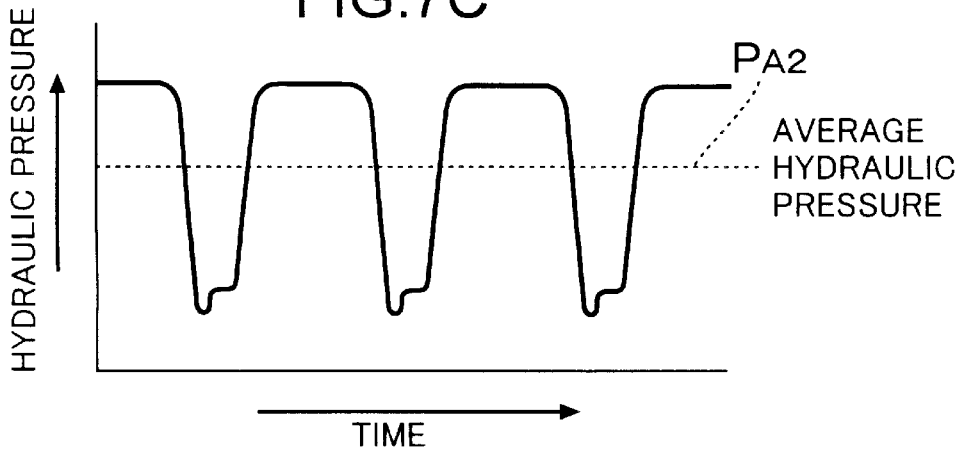
Figure 8:
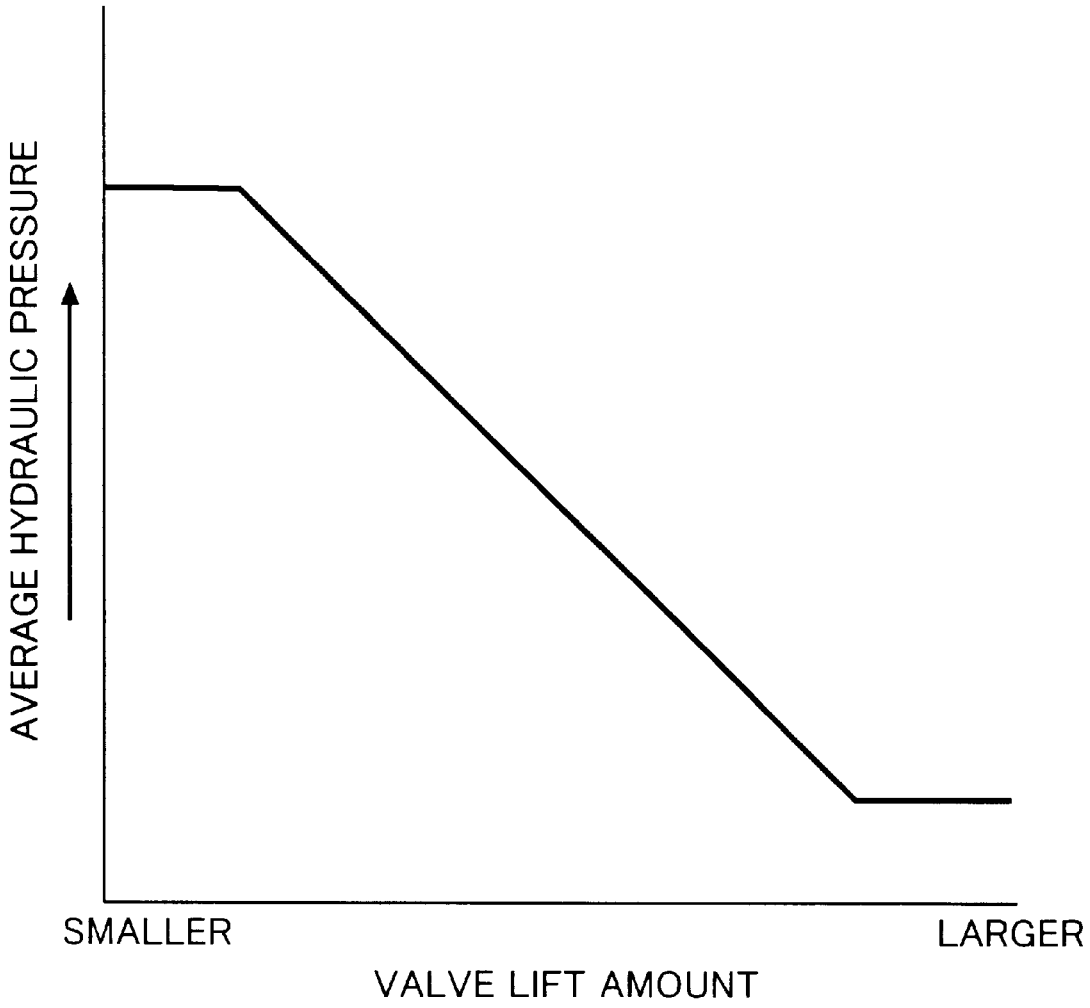
FIG. 8 is a diagram showing the average hydraulic pressure corresponding to the valve lift amount.

Therefore, the amount of oil released from the oil passage 57 via the first and second discharge bores 62 and 63, to the outside is increased in accordance with an increase in lift amount of the intake valve $V_I$, i.e., an increase in opening area of the intake valve bore 16. Thus, when the lift amount of the intake valve $V_I$ is relatively large, as shown by a line $L_1$ in FIG. 7A, the amount of oil released upon the opening of the intake valve $V_I$, is relatively large and the average hydraulic pressure $P_{A1}$ is relatively low, as shown in FIG. 7B. On the other hand, when the lift amount of the intake valve $V_I$ is relatively small, as shown by a line $L_2$ in FIG. 7A, the amount of oil released upon the opening of the intake valve $V_I$, is relatively small and the average hydraulic pressure $P_{A2}$ is relatively high, as shown in FIG. 7C. Thus, the average hydraulic pressure in the oil passage 57 is lowered, as the lift amount of the intake valve $V_I$ is increased, as shown in FIG. 8.

Each of the second discharge bores 63, 63 is provided in the sun gear 37 with an opening in its outer end being turned to the ring gear 38, so that the oil discharged from the second discharge bore 63, 63 is released toward the ring gear 38.

The intake valves $V_I$ for the cylinders are different in opening timing from one another, but are controlled so that the same lift amount is achieved. To detect the lift amounts of the intake valves $V_I$ for the cylinders, a single hydraulic pressure sensor 64 is mounted between the single oil passage 57 common to the cylinders and the single oil supply means 58 common to the cylinders, as shown in FIG. 6.

The value detected by the hydraulic pressure sensor 64 is inputted to a control unit U. The control unit U includes a filter 65 to which the value detected by the hydraulic pressure sensor 64 is inputted and which forms a hydraulic pressure detecting means 66 together with the hydraulic pressure sensor 64. An operational amount control means 67 controls the amount of operation of the rotational amount control means 48, to allow the operational characteristic of the intake valves $V_I$ to approach a target characteristic on the basis of a signal from the hydraulic pressure detecting means 66. An abnormality detecting means 68 detects an abnormality in the operation of the intake valves $V_I$ on the basis of the signal from the hydraulic pressure detecting means 66, and an abnormality notifying means 69 is connected to the abnormality detecting means 68 and adapted to be operated for notification when an abnormality is detected by the abnormality detecting means 68.

The filter 65 ensures that whereas the output from the hydraulic pressure sensor 64 assumes waveforms as shown in FIGS. 7B and 7C, an average hydraulic pressure can be simply obtained by averaging the outputs from the hydraulic pressure sensor 64. The lift amount of the intake valves $V_I$ can be determined from the average hydraulic pressure obtained in the filter 65 on the basis of the characteristic shown in FIG. 8.

Figure 9:
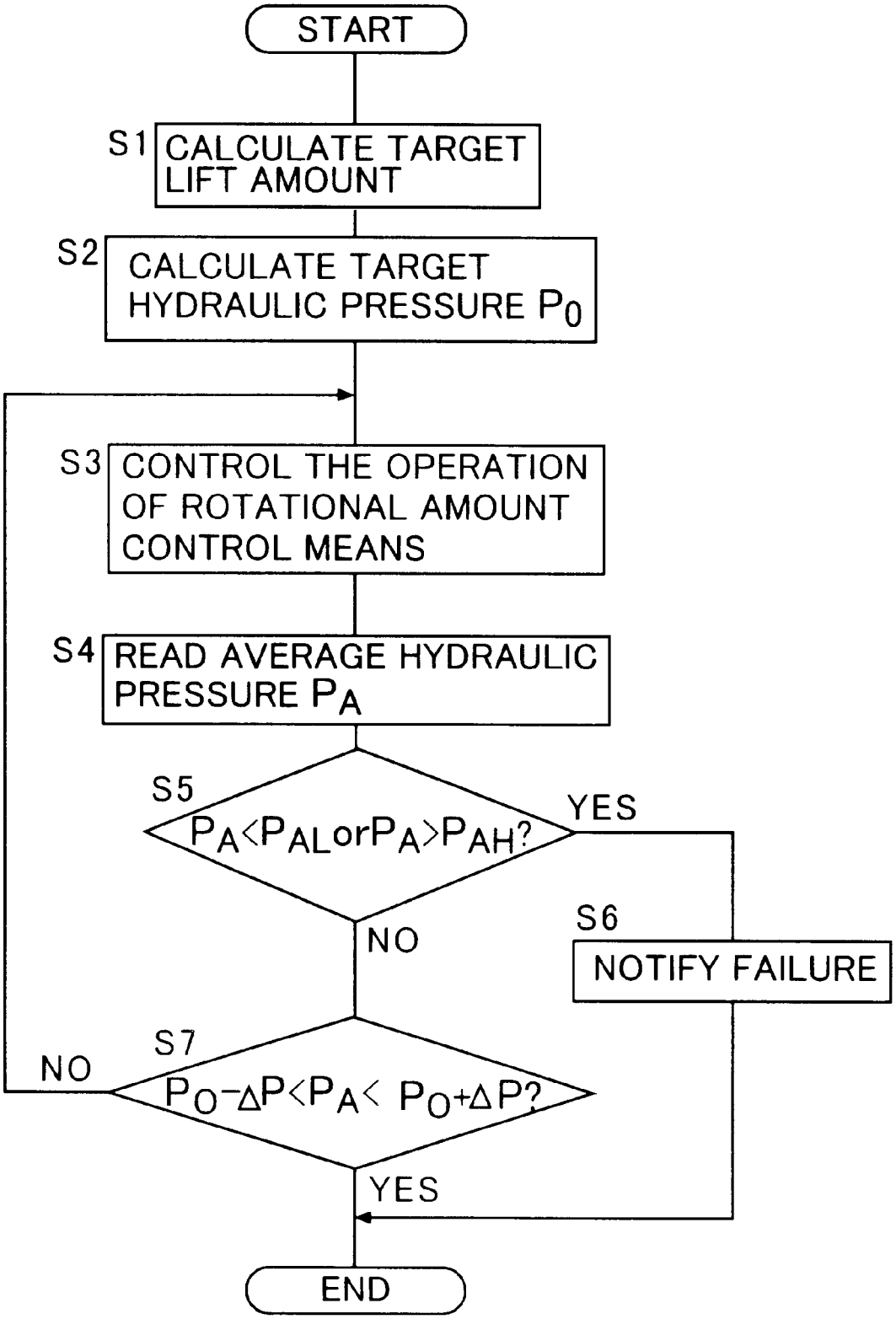
FIG. 9 is a flow chart showing the procedure for controlling the valve operational characteristic.

In the control unit U, a feedback control of the intake valve $V_I$ or the determination of an abnormality is carried out, for example, according to a procedure shown in FIG. 9 on the basis of the average hydraulic pressure obtained in the hydraulic pressure detecting means 66.

At step S1 in FIG. 9, a target lift amount of the intake valve $V_I$ is calculated in accordance with an operational state of the engine, and at step S2, a target hydraulic pressure $P_0$ corresponding to the target lift amount is calculated. At step S3, the operation of the rotational amount control means 48 in the intake-side valve operating device $\mathbf{31}_I$ is controlled in accordance with the target lift amount.

At step S5, the average hydraulic pressure $P_A$ obtained in the hydraulic pressure detecting means 66, is read and at next step S6, it is determined whether at least one of a condition where the average hydraulic pressure $P_A$ is smaller than a lower limit value $P_{AL}$ ($P_A<P_{AL}$), which does not occur in the normal operation of the rotational amount control means 48, and a condition where the average hydraulic pressure $P_A$ exceeds an upper limit value $P_{AH}$ ($P_A>P_{AH}$) which does not occur in the normal operation of the rotational amount control means 48, is established or not. When at least one of the two conditions is established at step S6, it is determined that there is an abnormality, progressing to step S7, at which the abnormality is notified by a warning or the like. When neither of the conditions are established at step S6, it is determined at step S8 whether the detected average hydraulic pressure $P_A$ is in a range ($P_0-\Delta P<P_A<P_0+\Delta P$) in which the target hydraulic pressure $P_0$ is provided with a margin ($\Delta P$). When the detected average hydraulic pressure $P_A$ is out of the range, the processing is returned to step S3.

The operation of the first embodiment will be described below. Among the three components forming the power transmitting means 36 of the planetary gear mechanism in the intake-side valve operating device $\mathbf{31}_I$, i.e., the sun gear 37, the ring gear 38 and the carrier 39, the ring gear 38 and the sun gear 37 are operatively connected to the intake-side valve operating cam $\mathbf{29}_I$ of the cam shaft 28 and the intake valves $V_I$, so that the amount of rotation, i.e., the amount of revolution of the carrier 39 about the sun gear 38 is continuously controlled by the rotational amount control means 48. Therefore, the operational characteristic of the intake valves $V_I$ can be controlled continuously and finely.

The power transmitting means 36 is a planetary gear mechanism comprised of the three components forming the power transmitting means 36, i.e., the sun gear 37, the ring gear 38 and the carrier 39, are rotatably disposed about the same axis. Therefore, the compactness of the power transmitting means 36, i.e., the reduction in size of the valve operating device $\mathbf{31}_I$, can be achieved, and the operational characteristics of the intake valves $V_I$ can be controlled precisely by the meshing connection of the components 37, 38 and 39 forming the power transmitting means 36.

In such power transmitting means 36, the amount of rotation of the ring gear 38 relative to the amount of rotation of the sun gear 37 is small. The ring gear 37 is operatively connected to the intake-side valve operating cam $\mathbf{29}_I$ of the cam shaft 28, and the sun gear 37 is operatively connected to the intake valves $V_I$. Therefore, the size of the intake-side valve operating cam $\mathbf{29}_I$ relative to the lift amount required for the intake valves $V_I$, i.e., the amount of rotation of the sun gear 37, can be set to a relatively small size. Thus, the load received by the ring gear 38 from the intake-side valve operating cam $\mathbf{29}_I$ can be reduced to a relatively small value, to contribute to the alleviation of the valve operating load. Since the roller 43 carried on the arm 42 of the ring gear 38, is in rolling contact with the intake-side valve operating cam $\mathbf{29}_I$, the valve operating load can be further reduced. Further, since the intake-side valve operating cam $\mathbf{29}_I$ is relatively small in size, the space required for rotation of the valve operating cam $\mathbf{29}_I$ as well as the space required for operation of the arm 42 of the ring gear 38 is also relatively small, thereby enabling compactness in the valve operating chamber in which the intake-side valve operating device $\mathbf{31}_I$ is disposed.

Moreover, by the fact that the single ring gear 38 is disposed between the pair of intake valves $V_I$ adjacent in an axial direction of the cam shaft 28, and the intake valves $V_I$ are operatively connected to the sun gear 37 on the axially opposite sides of the ring gear 38, respectively, the pair of intake valves $V_I$ can be opened and closed by the power transmitting means 36 disposed in a compact manner between the intake valves $V_I$, so that the operational characteristic thereof can be changed. Thus, the intake-side valve operating device $\mathbf{31}_I$ can be made more compact.

Further, by the fact that the cam shaft 28 is disposed in a position in which it is sandwiched between the intake valves $V_I$ and the exhaust valves $V_E$ below the upper ends of the intake valves $V_I$ and the exhaust valves $V_E$, and the operative connected points of the intake-side valve operating cam $\mathbf{29}_I$ and the ring gear 38 are disposed between the intake valves $V_I$ and the cam shaft 28, the power transmitting means 36 can be disposed in proximity to the upper surface of the cylinder head 14, thereby providing further compactness in the valve operating chamber. Moreover, since the intake-side and exhaust-side valve operating cams $\mathbf{29}_1$ and $\mathbf{29}_E$ are immersed in the oil within the oil bath 30 defined in the upper surface of the cylinder head 14, the lubrication of the power transmitting means 36 can be performed satisfactorily in such a manner that the oil can be raked up by the intake-side and exhaust-side valve operating cams $\mathbf{29}_I$ and $\mathbf{29}_E$ by the formation of the oil bath in which the intake-side and exhaust-side valve operating cams $\mathbf{29}_I$ and $\mathbf{29}_E$ can be immersed.

In the power transmitting means 36, the amount of relative angular displacement of the sun gear 37 relative to the support shaft 41 is changed with the change in lift amount of the intake valves $V_I$. The first discharge bore 62 is provided in the support shaft 41 to communicate with the oil passage 57 provided in the support shaft 41, and the second discharge bore 63 with its area of communication with the first discharge bore 62 being changed with the change in amount of relative angular displacement of the sun gear 37 relative to the support shaft 41, is provided in the sun gear 37. Therefore, the hydraulic pressure in the oil passage 57 is changed by the changing of the area of communication of the second discharge bore 63 with the first discharge bore 62. Thus, the lift states of the engine valves can be easily detected by detecting the changing of the hydraulic pressure using the hydraulic pressure detecting means 66, and the result of the detection can be practically utilized for feedback control, the determination of a failure or the like.

Moreover, the second discharge bore 63 opens toward the ring gear 38 of the power transmitting means 36, and the oil discharged from the second discharge bore 63 can be utilized effectively for the lubrication of the ring gear 38.

Further, by the fact that the single hydraulic pressure detecting means 66 common to the cylinders, is provided between the single oil passage 57 provided in the support shaft 41 common to the plurality of power transmitting means 36 having a plurality of cylinders and the single oil supply means 58, the lift states of the intake valves $V_I$ for the cylinders, can be easily detected with a smaller number of parts. By the fact that the hydraulic pressure detecting means 66 includes the hydraulic pressure sensor 64 and the filter 65 to which the value detected by the hydraulic pressure sensor 64 is inputted, the value detected by the hydraulic pressure sensor 64 can be simply averaged by the filter 65, and the lift states of the intake valves $V_I$ can be easily detected by the averaged hydraulic pressure.

Figure 10:
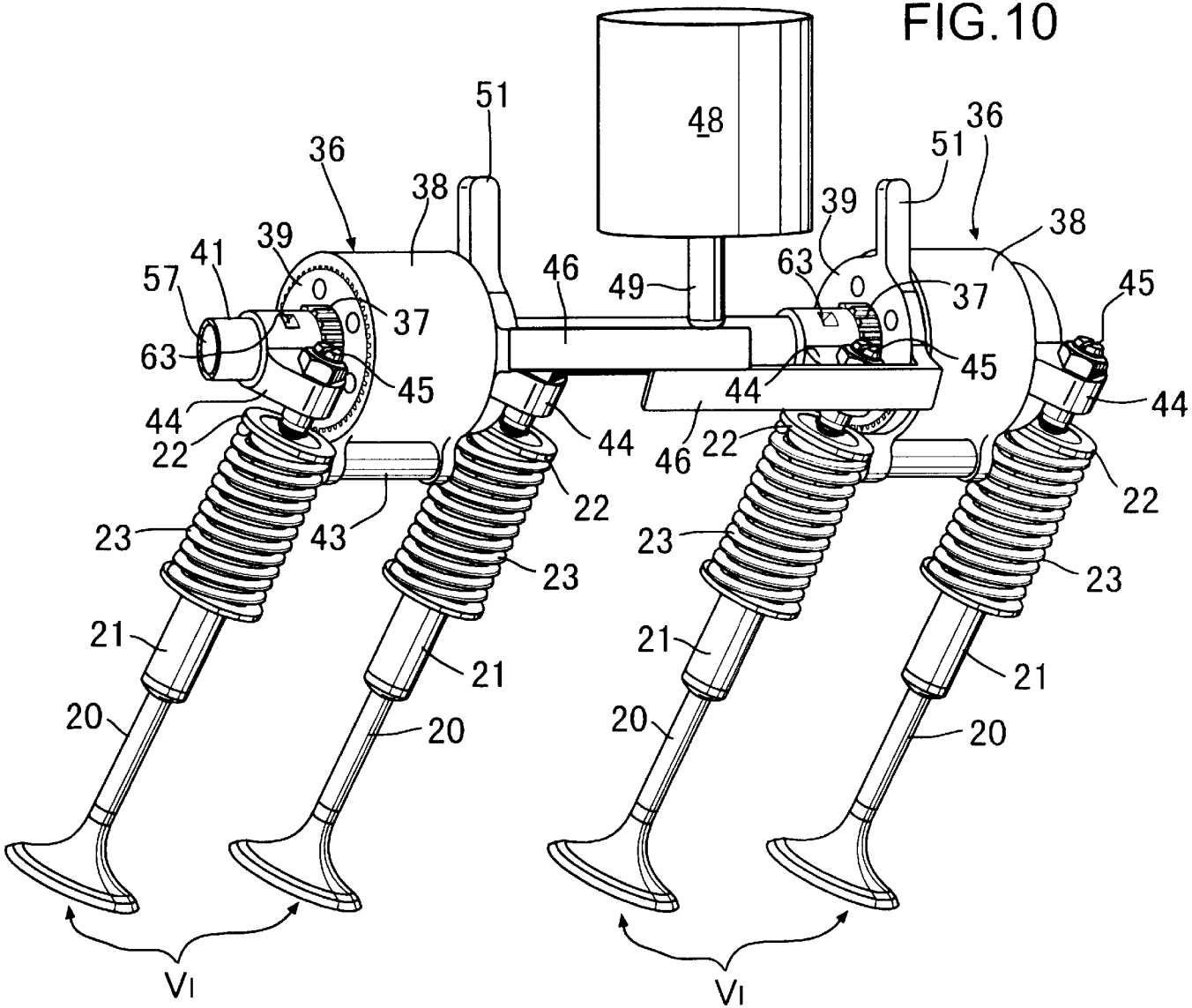
FIG. 10 is a perspective view similar to FIG. 5, but according to a second embodiment of the present invention.

FIG. 10 shows a second embodiment of the present invention. In the second embodiment, a rotational amount control means 48 may be disposed commonly to the two adjacent cylinders in which the timing of opening of valves are not overlapped with each other in a multi-cylinder internal combustion engine. Thus, in the two adjacent cylinders in which the timing of opening of the valves are not overlapped with each other, the control force may be provided by the rotational amount control means 48, synchronously with the opening timing of each cylinder. With such arrangement, a reduction in number of parts can be achieved.

In this case, as shown in FIG. 10, the control arms 46, 46 in the power transmitting means 36, 36 for the two adjacent cylinders may be superposed on one another, so that the control rod 49 of the rotational amount control means 48 is brought into contact with the superposed portions of the control arms 46, 46. Alternatively, the control arms 46 of the power transmitting means 36, 36 for the two adjacent cylinders may be formed integral with each other.

In each of the above-described embodiments, the ring gear 38 of the power transmitting means 36, is connected to the cam shaft 28, the sun gear 37 is connected to the intake valves $V_I$, and the carrier 33 is connected to the rotational amount control means 48. However, the connection relationship between the sun gear 37, the ring gear 38 and the carrier 39 forming the power transmitting means 36 with the cam shaft 28, the intake valve $V_I$ and the rotational amount control means 48 can be selected freely.

A linear solenoid, a step motor or the like can be employed as the rotational amount control means. When the step motor is employed, one of the three components forming the power transmitting means which controls the rotational amount by the step motor can be mechanically locked and hence, the accuracy of control of the valve operating characteristic can be enhanced, and the reduction in size of the valve operating device can be achieved.

Any of the power transmitting means (traction drive) of a planetary friction mechanism as disclosed in Japanese Patent Application Laid-open Nos.5-33840, 5-79450, 5-157149, 6-34005 and 6-66360 can be employed as the power transmitting means.

The amount of rotation of one of the three components forming the power transmitting means which is operatively connected to the rotational amount control means, can be controlled in a plurality of stages rather than continuously. In this case, the operational characteristic of the engine valve can be finely controlled by setting the number of stages at a larger value.

Further, in changing the operational characteristic of the intake valves $V_I$, either one of the opening lift amount and the opening timing of the intake valve $V_I$ can be changed, and the present invention can be applied to the exhaust valve as the engine valves.

In the embodiments, the oil supply means 58 discharges the oil under the normally given pressure, because the arrangement is simple and the lift states of the intake valves $V_I$ can be detected easily. However, the oil discharge pressure may be varied, and the lift states of the engine valves can be detected by detecting the variation in hydraulic pressure from the oil discharge pressure. The second discharge bore 63 is not necessarily provided in the sun gear 37 as the inner wheel, and may be provided in the member operated with such inner wheel.

Further, in the embodiments, the amount of rotation of the third component of the three components forming the power transmitting means is controlled by the rotational amount control means. However, the present invention can also be applied to a valve operating system in which driving force is provided to the third component to allow the engine valve to operate in a direction to be open.

Moreover, the present invention includes the oil passage to continuously change the hydraulic pressure in accordance with a change in lift amount of the engine valve irrespective of the arrangement of a mechanism for opening and closing the engine valve, and can be applied widely to a valve operating system which can change the operational characteristic of the engine valve. Also in this case, the lift states of the engine valves can be easily detected by detecting the changing of the hydraulic pressure in the oil passage using the hydraulic pressure detecting means.

As discussed above, the first, second and third components forming the power transmitting means are connected to the cam shaft, the engine valve and the rotational amount control means, and the amount of rotation of the third component connected to the rotational amount control means, is controlled by the rotational amount control means. Thus, the amount of rotation of the second component connected to the engine valve, i.e., the operational characteristic of the engine valve, is controlled. The amount of rotation of the third component is controlled more finely by the rotational amount control means. It is thus possible to more finely control the operational characteristic of the engine valve in accordance with the operational state of the engine. Moreover, by the fact that the three components forming the power transmitting means, i.e., the inner wheel, the outer wheel and the carrier, are disposed for rotation about the same axis, the power transmitting means can be formed compactly and the size of the valve operating system can be reduced. Further, the hydraulic pressure in the oil passage is changed by changing of the area of communication of the second discharge bore, with the first discharge bore, with a change in lift amount of the engine valve. Thus, it is possible to easily detect the lift state of the engine valve by detecting the change in hydraulic pressure by the hydraulic pressure detecting means.

The power transmitting means is formed into the planetary gear mechanism. Therefore, the operational characteristic of the engine valve can be controlled precisely by the meshing connection of the components forming the power transmitting means with one another.

Further, the oil discharged from the second discharge bore can be effectively utilized for lubrication of the outer wheel.

The lift state of the engine valve for each of the cylinders can be detected easily with a smaller numbers of parts.

Also, the average hydraulic pressure can be detected simply, and the lift state of the engine valve can be determined easily.

Feedback control of the engine valve can be carried out with a simple arrangement, leading to an enhanced accuracy of the control of the operational characteristic of the engine valve.

Further, the abnormality in the operation of the engine valve can be detected with the simple arrangement.

Although the embodiments of the present invention have been described in detail, it will be understood that the present invention is not limited to the above-described embodiments, and various modifications in design may be made without departing from the scope of the present invention defined in claims.

What is claimed is:

1. A valve operating system in an internal combustion engine wherein an operational characteristic of an engine valve is changed in accordance with an operational state of the engine, said valve operating system comprising:

(a) a power transmitting means including a support shaft having an oil passage therein, an inner wheel supported on said support shaft for rotation about an axis of said support shaft, an outer wheel surrounding said inner wheel, said outer wheel rotating about the axis of said support shaft, and a carrier for carrying a planetary rotor positioned between said inner wheel and said outer wheel, such that said planetary rotor is rotatable about an axis parallel to axes of said inner and outer wheels and said carrier is rotated in operative association with a revolution of said planetary rotor about said inner wheel;

(b) a cam shaft;

(c) a valve operating cam provided on said cam shaft, wherein one of said inner wheel, said outer wheel and said carrier is operatively connected to said valve operating cam and is rotatable in response to the rotation of said cam shaft, and another of said inner wheel, said outer wheel and said carrier is operatively connected to said engine valve;

(d) a rotational amount control means operatively connected to a remaining one of said inner wheel, said outer wheel and said carrier for controlling the amount of rotation of said remaining one in accordance with the operational state of the engine;

(e) an oil supply means connected to said oil passage for discharging oil at given pressure; and (f) a hydraulic pressure detecting means between said oil supply means and said oil passage, wherein said support shaft has a first discharge bore formed therein communicating with said oil passage, and said inner wheel or a member integrally movable with the inner wheel has a second discharge bore formed therein communicating with said first discharge bore, such that an area of communication of said second discharge bore with said first discharge bore can be varied, as the amount of relative angular displacement of said inner wheel relative to said support shaft is changed in accordance with a change in lift amount of said engine valve.

2. A valve operating system in an internal combustion engine according to claim 1, wherein said power transmitting means is a planetary gear mechanism, said inner wheel being a sun gear, said outer wheel being a ring gear and said planetary rotor being a planetary gear.

3. A valve operating system in an internal combustion engine according to claim 1, wherein said second discharge bore opens toward said outer wheel.

4. A valve operating system in an internal combustion engine according to claim 2, wherein said second discharge bore opens toward said outer wheel.

5. A valve operating system in an internal combustion engine according to claim 1, wherein said hydraulic pressure detecting means is a single hydraulic pressure detecting means, common to a plurality of cylinders in said engine, positioned between said oil supply means which is a single oil supply means and said oil passage which is a single oil passage in said support shaft.

6. A valve operating system in an internal combustion engine according to claim 2, wherein said hydraulic pressure detecting means is a single hydraulic pressure detecting means, common to a plurality of cylinders in said engine, positioned between said oil supply means which is a single oil supply means and said oil passage which is a single oil passage in said support shaft.

7. A valve operating system in an internal combustion engine according to claim 1, wherein said hydraulic pressure detecting means includes a hydraulic pressure sensor, and a filter which is input with a value detected by said hydraulic pressure sensor.

8. A valve operating system in an internal combustion engine according to claim 2, wherein said hydraulic pressure detecting means includes a hydraulic pressure sensor, and a filter wherein a value detected by said hydraulic pressure sensor is input to said filter.

9. A valve operating system in an internal combustion engine according to claim 1, further including an operational amount control means for controlling the amount of operation of said rotational amount control means to allow the operational characteristic of said engine valve to approach a target characteristic based upon a value detected by said hydraulic pressure detecting means.

10. A valve operating system in an internal combustion engine according to claim 2, further including an operational amount control means for controlling the amount of operation of said rotational amount control means to allow the operational characteristic of said engine valve to approach a target characteristic based upon a value detected by said hydraulic pressure detecting means.

11. A valve operating system in an internal combustion engine according to claim 1, further including an abnormality detecting means for detecting an abnormality in the operational state of said engine valve based upon a value detected by said hydraulic pressure detecting means.

12. A valve operating system in an internal combustion engine according to claim 2, further including an abnormality detecting means for detecting an abnormality in the operational state of said engine valve based upon a value detected by said hydraulic pressure detecting means.

* * * * *